US010851771B2

(12) United States Patent
Xu

(10) Patent No.: US 10,851,771 B2
(45) Date of Patent: Dec. 1, 2020

(54) PORTABLE BATTERY STEAM CLEANER

(71) Applicant: Beijing China Base Startrade Co., Ltd., Fangzhuang (CN)

(72) Inventor: Shihui Xu, Fangzhuang (CN)

(73) Assignee: Beijing China Base Startrade Co., Ltd., Fangzhuang (CN)

( * ) Notice: Subject to any disclaimer, the term of this patent is extended or adjusted under 35 U.S.C. 154(b) by 0 days.

(21) Appl. No.: 15/528,806

(22) PCT Filed: Jul. 29, 2016

(86) PCT No.: PCT/CN2016/092216

§ 371 (c)(1),
(2) Date: May 23, 2017

(87) PCT Pub. No.: WO2018/018576

PCT Pub. Date: Feb. 1, 2018

(65) Prior Publication Data

US 2018/0216611 A1 Aug. 2, 2018

(51) Int. Cl.
*B08B 3/10* (2006.01)
*F04B 43/12* (2006.01)
(Continued)

(52) U.S. Cl.
CPC ..... *F04B 43/12* (2013.01); *A47L 11/34* (2013.01); *A47L 11/4005* (2013.01); *A47L 11/4011* (2013.01); *A47L 11/4086* (2013.01); *B08B 3/00* (2013.01); *B08B 3/026* (2013.01); *B08B 3/10* (2013.01); *E01H 1/00* (2013.01); *F22B 1/282* (2013.01); *F22B 27/08* (2013.01);
(Continued)

(58) Field of Classification Search
CPC .... A47L 11/34; A47L 11/4086; A47L 13/225; B08B 3/10; F22B 1/282; F22B 1/284; F22B 1/288; F22B 27/08
See application file for complete search history.

(56) References Cited

U.S. PATENT DOCUMENTS 4,414,037 A * 11/1983 Friedheim ..... B08B 3/02 122/40
5,287,588 A * 2/1994 Gurstein ..... A47L 11/4088 15/321

(Continued)

FOREIGN PATENT DOCUMENTS

EP 0703407 A1 * 3/1996 ..... A47L 11/34
KR 20070010518 A * 1/2007

OTHER PUBLICATIONS

KR20070010518—Machine Translation (Year: 2007).*

*Primary Examiner* — Marc Lorenzi
(74) *Attorney, Agent, or Firm* — Meister Seelig & Fein LLP; Seth H. Ostrow, Esq.

(57) ABSTRACT

The present invention provides a portable battery steam cleaner comprising in combination of a hollow main body, in which a water tank, peristaltic pump, control system and lithium battery; the water tank in connection with the input of the peristaltic pump; the output of the peristaltic pump in connection with one end of silicone hose; and the other end of silicone hose in connection with the steam generator. The present invention can continuously transport liquid from the water tank, through the silicone hose, into the steam generator, and thus eject steam continuously for cleaning purposes.

9 Claims, 2 Drawing Sheets

(51) Int. Cl.

| | |
|---|---|
| ***F22B 1/28*** | (2006.01) |
| ***A47L 11/40*** | (2006.01) |
| ***B08B 3/02*** | (2006.01) |
| ***E01H 1/00*** | (2006.01) |
| ***F22B 35/10*** | (2006.01) |
| ***A47L 11/34*** | (2006.01) |
| ***F22B 27/08*** | (2006.01) |
| ***B08B 3/00*** | (2006.01) |

(52) U.S. Cl.
CPC ..... *F22B 35/10* (2013.01); *B08B 2203/007* (2013.01); *B08B 2230/01* (2013.01)

(56) References Cited

U.S. PATENT DOCUMENTS 7,849,556 B1 * 12/2010 Jansen ..... A47L 11/34 15/320
8,549,697 B1 * 10/2013 Moyher, Jr. ..... A47L 11/34 15/319
9,433,951 B1 * 9/2016 Arnold ..... B05B 9/002
9,516,986 B1 * 12/2016 Williams ..... A47L 11/4086
2003/0196292 A1 * 10/2003 Sams ..... A47L 5/38 15/314
2006/0018638 A1 * 1/2006 Leung ..... B08B 3/00 392/403
2007/0133962 A1 * 6/2007 Rizzuto ..... A47L 1/08 392/324
2008/0022480 A1 * 1/2008 Lee ..... B08B 3/00 15/320
2012/0282153 A1 * 11/2012 Cheong ..... F22B 1/282 422/292
2014/0165324 A1 * 6/2014 Luo ..... A47L 11/4086 15/320
2015/0020329 A1 * 1/2015 Hansen ..... A47L 11/4086 15/104.93
2016/0106287 A1 * 4/2016 Hussey ..... B08B 3/026 15/320
2016/0374533 A1 * 12/2016 Innes ..... A47L 13/12 15/319
2017/0319040 A1 * 11/2017 Whitbread ..... A47L 11/4086

* cited by examiner

PORTABLE BATTERY STEAM CLEANER

FIELD OF THE INVENTION

The present invention relates to a cleaner and, more particularly, to a portable battery-powered steam cleaner.

BACKGROUND OF THE INVENTION

Steam cleaning units presently on the market use a boiler heating method to generate steam. This method not only consumes a high level of power and energy, but also causes dangerous steam pressure. If the boiler pressure becomes too high, the temperature would need to be controlled. Therefore, the time required to produce steam in existing steam cleaning units is considerably long. On the other hand, any steam cleaners that try to generate significant steam volume while maintaining a safe boiler pressure would require a strict temperature control system. Such generators would not be able to continuously produce steam due to the lack of a constant temperature. In addition, existing steam cleaners use alternating current (AC), which requires extension cords, making it inconvenient for public use. Therefore, they have significant accessibility limitations.

SUMMARY OF THE INVENTION

To solve the above-mentioned problems, the present invention provides a portable battery steam cleaner with dirt removing functions without operation accessibility issues.

To realize such object, the present invention adopts a technical device comprising in combination:

- a hollow main body, including a water tank, peristaltic pump, control system and lithium battery;
- the abovementioned water tank in connection to the input of a peristaltic pump;
- the output of the peristaltic pump in connection to one end of a silicone hose, and the other end of the hose to stretch out of the main body to be connected with a steam generator;
- a control system in connection to the peristaltic pump and steam generator power, to control the working status of the peristaltic pump and steam generator;
- the steam generator to include a tubular cavity with a helical tube that coils around the exterior of the tubular cavity; one end of the aforementioned helical tube in connection with the tubular cavity, while the other end connects with the silicone hose.
- a water level sensor in the main body, which connects with the control system power;
- a fuse in the main body, which connects with the control system, to protect the circuit of the control system;
- a temperature protector and a temperature control probe attached on the steam generator, both in connection with the control system power;
- a handle grip in extension from the main body;
- an adjustable shoulder strap, attached to the main body;
- an ejector pipe in connection with a round cleaning brush;
- the ejector pipe also in connection with a flat cleaning brush;
- and a thermal protective coating surrounding the steam generator.

The invention provides the following advantages:

1. Since the system's water tank connects to the peristaltic pump, which connects to the silicone hose, which connects to the steam generator, it can continuously transport liquid from the water tank to the generator, thus continuously ejecting steam without interruption for cleaning purposes.
2. The lithium battery powers the peristaltic pump through the control system, and thus is able to continuously pump liquid from the water tank to the generator to be vaporized. This replaces AC power, which requires an extension cord. It is lightweight, convenient to use, and completely portable, with limitations on the working areas.
3. The water level sensor sounds the alarm when it detects a lack of water, while also turning off the heating rod power supply, improving safety.
4. A closed system of heat exchange provided by the steam generator improves work efficiency and usage cost:
   - The tubular cavity allows for liquid to be exposed directly to the heating rod, ensuring direct heat transfer.
   - Any heat transferred through the tubular cavity to the water inside the helical tube is not lost as it serves the function of preheating the water coming from the water tank. This water is directed back into the tubular cavity to be further heated, ensuring heat and energy loss is at an absolute minimum.
   - Optimal dimensions between the heating rod and the interior wall of the tubular cavity can generate instant steam.
5. A dial on the exterior of the main body adjusts the pump speed, allowing users to clean with steam of various functions (dry steam can be generated by slowing down the pump speed, while turning up the pump speed produces wet steam, which is better for chewing gum removal).
6. The adjustable shoulder strap and handle grip provides ease of operation and portable moving.

DETAILED DESCRIPTION OF THE INVENTION

The following is a detailed explanation of the invention, with references to the attached drawings.

Figure 1:
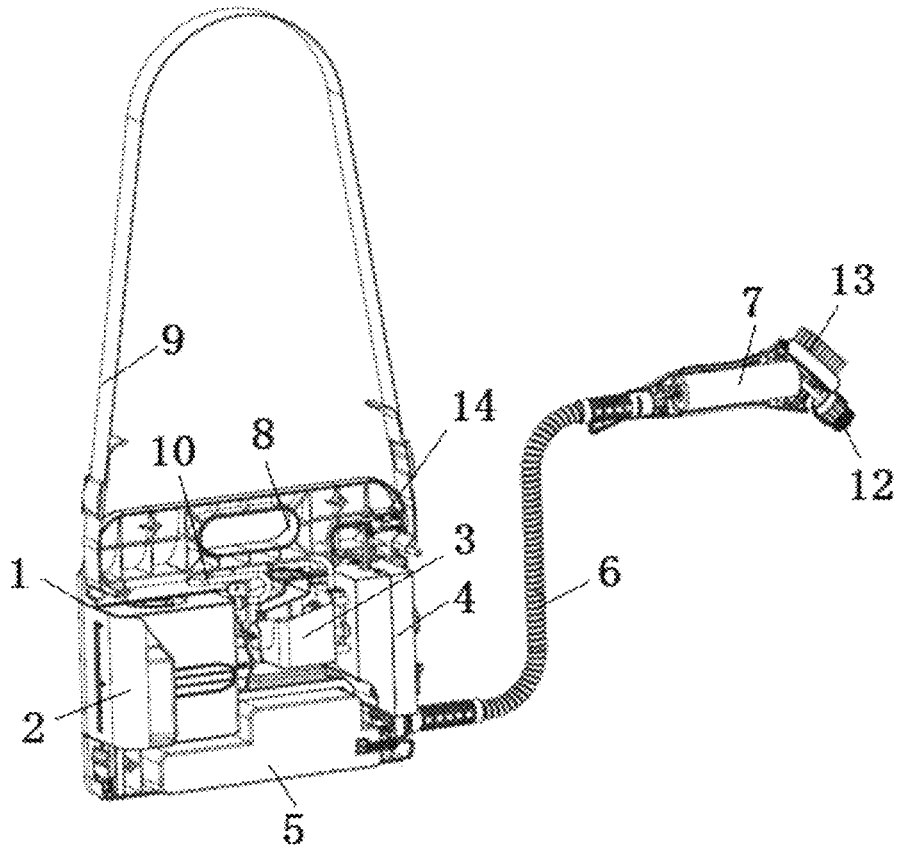
FIG. 1 illustrates a cross-sectional view of the invention.

Referring to FIG. 1, this invention includes a hollow main body 1, including a water tank 2, a peristaltic pump 3, a control system 4, and a lithium battery 5. The water tank 2 connects with the input of the peristaltic pump 3, and the output of the peristaltic pump 3 connects with one end of the silicone hose 6. The other end of the silicone hose 6 stretches out of the main body 1 and connects with the steam generator, while the lithium battery 5 provides power for the whole cleaner. Control system 4 separately connects with the peristaltic pump 3 and steam generator 7, and serves the function of controlling the working status of the pump 3 and generator 7.

Figure 2:
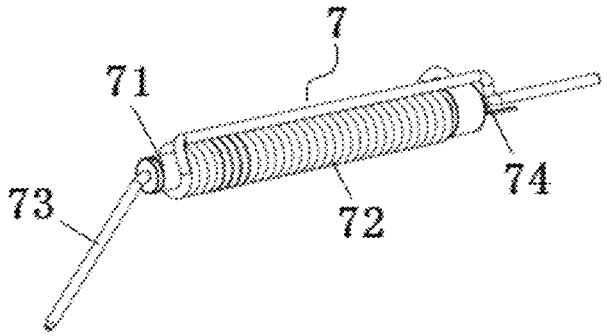
FIG. 2 illustrates a side view of a steam generator.
Figure 3:
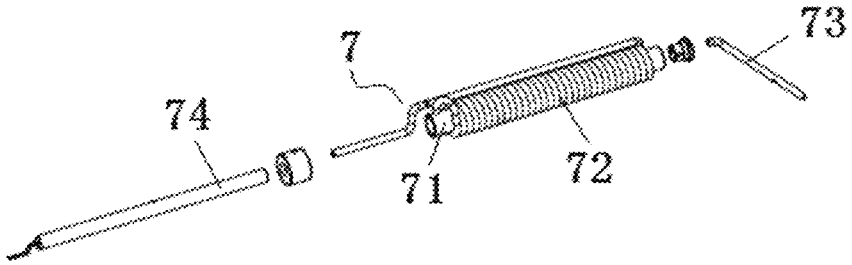
FIG. 3 illustrates an exploded view of the steam generator.

Referring now to FIGS. 2-3, the steam generator 7 consists of a tubular cavity 71, around which a helical tube coils 72. The coil 72 connects the silicone hose 6 with the tubular cavity 71, feeding liquid from the main body 1 into the cavity 71. A heating rod 74 inside 71 heats and vaporizes the liquid, which then ejects from the steam eject pipe 73. The heating rod 74 connects with and is powered by the control system 4.

Referring to FIG. 1, water level sensor 10 sits in the main body 1, and connects with the control system 4. When sensor 10 detects a lack of water in the water tank 2, control system 4 will sound the sensor alarm with a buzzer warning, and turn off the heating rod 74.

Fuse holder 14 sits in the main body 1 and connects with control system 4, to protect the control system 4's circuit.

Figure 4:
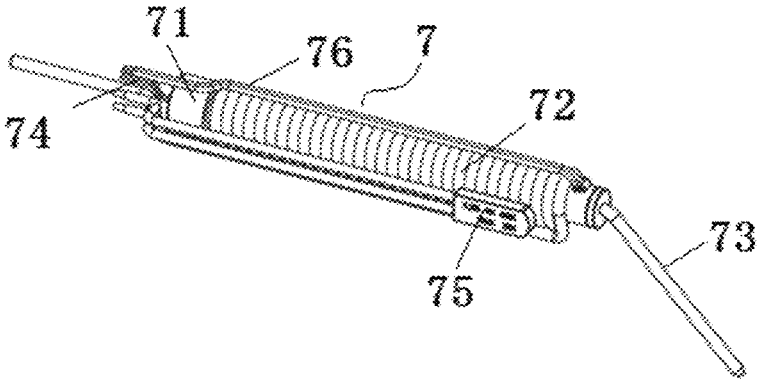
FIG. 4 illustrates another view of the steam generator.

Referring to FIG. 4, temperature protector 75 and temperature control probe 76 are attached onto the steam generator 7. Temperature protector 75 and temperature control probe 76 are electrically connected to control system 4, to control the internal temperature of 7 and avoid overheating.

Referring to FIG. 1, handle 8 extends from the main body 1.

Adjustable shoulder strap 9 is attached to the main body 1.

Referring to FIGS. 1 and 2, the end of steam eject pipe 73 connects with a round cleaning brush 12, which is used for removing gum and other sticky residue off of surfaces.

The end of steam generator 7 connects with a cleaning flat brush 13, which is used to further clean surfaces by abrasion.

Heat insulation casing (not shown) wraps around steam generator 7.

To operate the machine, a worker would first fill the water tank 2 with water and/or cleaning solution. The worker can carry the machine on his or her shoulder using strap 9, while one hand holds handle 8 and the other holds the wand in which steam generator 7 is located. After starting the machine, the control system 4 turns on peristaltic pump 3, which pumps liquid from the water tank 2 into the silicone hose 6. The silicone hose 6 transports liquid into the tubular cavity 71 through the helical tube 72. The heating rod 74 vaporizes the liquid into gas, which then ejects from steam eject pipe 73 onto the desired surface. The cleaning round brush 12 and flat brush 13 can be then used to remove gum and other sticky residue off of surfaces, seats, tables, walls and so on.

When the sensor 10 detects a lack of water in water tank 2, the control system 4 will sound the sensor 10 alarm with a buzzer sound, while turning off the heating rod 74.

When the double temperature sensors detect that the steam generator 7 is too hot, it will adjust the temperature of the heating rod 74 using the control system 4, to avoid equipment damage.

The above explains this invention and the structure of the parts. Connection method can be changeable, and any improvement based on this invention should not exclude the protection of this invention.

What is claimed is:

1. A portable battery steam cleaner comprising:

a hollow main body comprising a water tank, a peristaltic pump, a control system, and a lithium battery;

a handheld wand comprising a casing and a steam generator within the casing of the handheld wand, wherein the casing is located externally from the main body; and a silicone hose coupling the hollow main body and the handheld wand;

wherein the water tank in is connection with an input of the peristaltic pump, an output of the peristaltic pump is in connection to one end of the silicone hose, another end of the silicone hose is stretched out of the main body and connected to the handheld wand, wherein the control system is in connection with the peristaltic pump and the steam generator, and controls a working status of the peristaltic pump and the steam generator, wherein the handheld wand has a distal end and a proximal end, and wherein liquid is vaporized by the steam generator, the steam generator comprising a tubular cavity, helical tube coils, and a steam ejector pipe, wherein:

the helical tube coils are located around the tubular cavity between the distal and the proximal ends of the handheld wand, the helical tube coils having one end connected with the tubular cavity and another end connected with the hose, such that the hose feeds the liquid to the helical tube coils and the helical tube coils feed the liquid to the tubular cavity, the tubular cavity contains a heating rod therein, which connects with a control system power and which converts the liquid to steam, and the tubular cavity feeds into the steam ejector pipe, and the helical tube coils coil from the distal end of the handheld wand toward the proximal end, the heating rod preheats the liquid in the helical tube coils, and the liquid fed into the tubular cavity is exposed directly to the heating rod.

2. The portable battery steam cleaner according to claim 1, further including a water level sensor in the main body in connection with the control system power.

3. The portable battery steam cleaner according to claim 1, further including a fuse holder in the main body in connection with the control system power, for control system circuit protection.

4. The portable battery steam cleaner according to claim 1, wherein a temperature protector and a temperature control probe separately connects with the control system power.

5. The portable battery steam cleaner according to claim 1, further including a handle grip.

6. The portable battery steam cleaner according to claim 1, further including an adjustable shoulder strap.

7. The portable battery steam cleaner according to claim 1, wherein an end of the steam ejector pipe connects with a round cleaning brush.

8. The portable battery steam cleaner according to claim 1, wherein an end of the steam ejector pipe connects with a flat cleaning brush.

9. The portable battery steam cleaner according to claim 1, further including a thermal protective coating surrounding the steam generator.

* * * * *